US009863385B2

(12) United States Patent
Graham

(10) Patent No.: US 9,863,385 B2
(45) Date of Patent: Jan. 9, 2018

(54) FUEL INJECTOR

(71) Applicant: DELPHI INTERNATIONAL OPERATIONS LUXEMBOURG S.A.R.L., Bascharage (LU)

(72) Inventor: Mark S. Graham, Westbury-on-Trym (GB)

(73) Assignee: DELPHI INTERNATIONAL OPERATIONS S.A.R.L., Luxembourg (LU)

( * ) Notice: Subject to any disclaimer, the term of this patent is extended or adjusted under 35 U.S.C. 154(b) by 111 days.

(21) Appl. No.: 14/405,056

(22) PCT Filed: May 29, 2013

(86) PCT No.: PCT/EP2013/061054

§ 371 (c)(1),
(2) Date: Dec. 2, 2014

(87) PCT Pub. No.: WO2013/186051

PCT Pub. Date: Dec. 19, 2013

(65) Prior Publication Data

US 2015/0144710 A1 May 28, 2015

(30) Foreign Application Priority Data

Jun. 13, 2012 (EP) ..... 12171811

(51) Int. Cl.
*F02M 47/02* (2006.01)
*F02M 63/00* (2006.01)

(52) U.S. Cl.
CPC ..... *F02M 63/0014* (2013.01); *F02M 47/02* (2013.01); *F02M 63/0015* (2013.01); *F02M 63/0022* (2013.01); *F02M 2547/001* (2013.01)

(58) Field of Classification Search
CPC ..... F02M 63/0014; F02M 63/0015; F02M 63/0022; F02M 47/02; F02M 2547/001
(Continued)

(56) References Cited

U.S. PATENT DOCUMENTS 6,471,142 B1 * 10/2002 Lambert ..... F02M 45/08 239/88
6,557,776 B2 * 5/2003 Carroll, III ..... F02M 45/086 239/124
(Continued)

FOREIGN PATENT DOCUMENTS

EP 1 865 192 A2 12/2007
EP 1 626 173 B1 3/2008
(Continued)

OTHER PUBLICATIONS

International Search Report dated Aug. 12, 2013.

*Primary Examiner* — Arthur O Hall
*Assistant Examiner* — Joseph A Greenlund
(74) *Attorney, Agent, or Firm* — Joshua M. Haines

(57) ABSTRACT

The present invention relates to a fuel injector for use in delivering fuel to an internal combustion engine. The fuel injector includes a nozzle having a valve needle which is movable with respect to a valve needle seat. The valve needle travels through a range of movement between a closed position and an open position to control fuel delivery through at least one nozzle outlet. The valve needle cooperates with a needle sleeve or a control member which is located in a piston guide. The valve needle is movable relative to the needle sleeve or the control member. The needle sleeve or the control member is movable relative to the piston guide. The invention also relates to a method of operating a fuel injector; and a fuel injector control unit.

10 Claims, 10 Drawing Sheets

(58) Field of Classification Search
USPC ..... 239/5, 533.3–533.496
See application file for complete search history.

(56) References Cited

U.S. PATENT DOCUMENTS

| | | | | |
|---|---|---|---|---|
| 6,688,579 | B2 * | 2/2004 | Grytz | F02M 47/027 251/129.16 |
| 6,705,543 | B2 * | 3/2004 | Carroll, III | F02M 45/04 239/124 |
| 6,761,325 | B2 * | 7/2004 | Baker | F02M 43/02 239/533.2 |
| 6,944,273 | B2 * | 9/2005 | Huna | H04M 1/64 379/88.14 |
| 6,994,273 | B2 * | 2/2006 | Ganser | F02M 47/027 123/447 |
| 7,021,567 | B2 * | 4/2006 | Potz et al. | F02M 45/00 239/533.2 |
| 7,051,958 | B2 * | 5/2006 | Potz et al. | F02M 45/086 239/533.2 |
| 7,117,842 | B2 * | 10/2006 | Boehland | F02M 45/086 123/299 |
| 7,134,615 | B2 * | 11/2006 | Lawrence | F02M 57/025 239/533.3 |
| 7,334,741 | B2 * | 2/2008 | Benson | F02M 45/083 123/496 |
| 7,513,440 | B2 * | 4/2009 | Magel | F02M 47/025 239/124 |
| 7,559,488 | B2 * | 7/2009 | Smout | F02M 45/086 239/102.2 |
| 7,644,874 | B2 * | 1/2010 | Mochizuki | F02M 51/0603 123/498 |
| 7,740,187 | B2 * | 6/2010 | Ricco | F02M 47/027 239/533.1 |
| 7,891,586 | B2 * | 2/2011 | Ganser | F02M 47/027 123/456 |
| 8,069,840 | B2 * | 12/2011 | Magel | F02M 47/027 123/445 |
| 8,186,609 | B2 * | 5/2012 | Rapp | F02M 47/027 123/445 |
| 8,316,825 | B1 * | 11/2012 | French, III | F02M 51/0671 123/472 |
| 8,544,764 | B2 * | 10/2013 | Cooke | F02D 41/2096 239/102.2 |
| 8,573,186 | B2 * | 11/2013 | Rettich | F02M 47/027 123/446 |
| 8,800,529 | B2 * | 8/2014 | Wickstone | F02D 19/10 123/27 GE |
| 9,222,451 | B2 * | 12/2015 | Salcedo | F02M 51/0603 |
| 9,562,505 | B2 * | 2/2017 | Hokkanen | F02M 63/029 |
| 2004/0000600 | A1 * | 1/2004 | Peters | F02M 47/025 239/533.2 |
| 2005/0194468 | A1 * | 9/2005 | Brenk | F02M 45/086 239/533.3 |
| 2006/0202052 | A1 * | 9/2006 | Boecking | F02M 45/086 239/88 |
| 2007/0215116 | A1 * | 9/2007 | Boecking | F02M 47/027 123/472 |
| 2007/0215717 | A1 * | 9/2007 | Cooke | F02M 45/086 239/102.2 |
| 2008/0053408 | A1 * | 3/2008 | Futonagane | F02D 41/2096 123/456 |
| 2008/0283634 | A1 * | 11/2008 | Hlousek | F02M 47/027 239/585.5 |
| 2009/0266921 | A1 * | 10/2009 | Boecking | F02M 51/0603 239/585.5 |
| 2009/0308353 | A1 * | 12/2009 | Magel | F02M 47/027 123/472 |
| 2010/0012092 | A1 * | 1/2010 | Futonagane | F02M 45/086 123/457 |
| 2015/0040867 | A1 * | 2/2015 | Upadhye | F02M 47/02 123/456 |

FOREIGN PATENT DOCUMENTS

| | | | |
|---|---|---|---|
| JP | 201185103 | | 4/2001 |
| JP | 2006161678 | | 6/2006 |
| JP | 2006274841 | | 10/2006 |
| JP | 2007239735 | | 9/2007 |
| JP | 2009079485 | | 4/2009 |
| WO | 2004/070192 | A1 | 8/2004 |
| WO | 2010/088781 | A1 | 8/2010 |

* cited by examiner

FUEL INJECTOR

CROSS REFERENCE TO RELATED APPLICATIONS

This application is a national stage application under 35 U.S.C. 371 of PCT Application No. PCT/EP2013/061054 having an international filing date of 29 May 2013, which designated the United States, which PCT application claimed the benefit of European Patent Application No. 12171811,8 filed on 13 Jun. 2012, the entire disclosure of each of which are hereby incorporated herein by reference.

TECHNICAL FIELD

The present invention relates to a fuel injector for injecting fuel into a combustion chamber of an internal combustion engine.

BACKGROUND OF THE INVENTION

A fuel injector 1 will be described by way of background with reference to FIG. 1. The injector 1 comprises a nozzle body 3, an injector nozzle 5 and a movably mounted injector needle 7. The injector nozzle 5 comprises a plurality of nozzle holes 9 which can be selectively opened and closed by the injector needle 7 to inject fuel into a combustion chamber (not shown). Specifically, the injector needle 7 has a lower valve 11 for cooperating with a lower valve seat 13 formed in the injector nozzle 5. A spring 15 is provided in a spring chamber 17 for biasing the injector needle 7 in a downwards direction to seat the lower valve 11 in the lower valve seat 13, thereby closing the nozzle holes 9.

An upper end of the injector needle 7 extends into a control chamber 19 formed in a piston guide 20. The control chamber 19 is in fluid communication with the spring chamber 17 via an inlet orifice 21. A drain pathway 23, having a restricted drain orifice 25, forms a fluid pathway from the control chamber 19 to a low pressure fuel return line (not shown). The injector needle 7 has an upper valve 29 for cooperating with an upper valve seat 31 formed in the nozzle body 3 to seal the control chamber 19. A 3-way control valve (not shown) is provided for selectively opening and closing the drain pathway 23 to control the fuel pressure within the control chamber 19. The 3-way valve is actuated by an electro-mechanical solenoid (not shown).

A fuel supply line 33 supplies high pressure fuel from a fuel pump (not shown) to the injector nozzle 5 and the spring chamber 17. The control chamber 19 is selectively in fluid communication with the fuel supply line 33 via the inlet orifice 21. When the injector needle 7 is lifted, the upper valve 29 locates in the upper valve seat 31 and the control chamber 19 is isolated from the inlet orifice 21.

When the 3-way control valve is closed, there is no fluid communication between the control chamber 19 and the low pressure fuel return line. Accordingly, the fuel pressure in the injector nozzle 5 and the spring chamber 17 equalises and the spring 15 biases the injector needle 7 to a closed position in which the lower valve 11 is seated in the lower valve seat 13 and the nozzle holes 9 are closed, as shown in FIG. 1.

Conversely, when the 3-way control valve is opened, a path is formed which places the control chamber 19 in fluid communication with the low pressure fuel return line 27 and the fuel pressure in the control chamber 19 is reduced. Accordingly, the fuel pressure in the injector nozzle 5 is higher than the fuel pressure in the control chamber 19 and a pressure force applied to the injector needle 7 overcomes the bias of the spring 15. The injector needle 7 is displaced upwardly unseating the lower valve 11 from the lower valve seat 13. The nozzle holes 9 are thereby opened and fuel is injected from the injector nozzle 5 into the combustion chamber. The upwards displacement of the injector needle 7 causes the upper valve 29 to be seated in the upper valve seat 31 thereby closing the drain pathway 23 and inhibiting the flow of fuel to the low pressure return line.

The injector needle 7 can move between two steady state positions (fully open or fully closed). The opening and closing velocity of the injector needle 7 is controlled by the balance of pressures on the injector needle 7 as well as the biasing force applied by the spring 15. The opening and closing velocities are determined by the balance of pressures which, in part, relate to the component geometry. The maximum lift of the injector needle 7 is determined by component geometry. The sizing of the inlet orifice 21 and the outlet orifice 25 provide the main control for the speed that the injector needle 7 can move. As the 3-way control valve is opened, fuel escapes but is re-supplied via the inlet orifice 21. If the inlet orifice 21 is larger in comparison to the outlet orifice 25, damping of the lift of the injector needle 7 is increased. Conversely, if the inlet orifice 21 is smaller in comparison to the outlet orifice 25, the speed at which the injector needle 7 lifts is increased.

The fuel injector 1 can be used to inject fuel having a rate shape as illustrated in FIG. 2. The rate shape can be affected by rail pressure, but there is no ability to fundamentally adjust its profile (for example, the initial injection rate or closing rate) during operation.

An 'intensifier type' system can be used to generate injection rate flexibility within a common rail system, but still presents some limits on what rate shapes can be achieved. In addition intensifier systems generally have, by design, inherent hydraulic inefficiencies due to the way that the intensifier piston is hydraulically driven.

The present invention, at least in preferred embodiments, sets out to provide an improved fuel injector.

SUMMARY OF THE INVENTION

Aspects of the present invention relate to a fuel injector; a method of operating a fuel injector; and a fuel injector control unit.

In a further aspect, the present invention relates to a fuel injector for use in delivering fuel to an internal combustion engine, the fuel injector comprising: a nozzle having a valve needle which is movable with respect to a valve needle seat through a range of movement between a closed position and an open position to control fuel delivery through at least one nozzle outlet; the valve needle cooperating with a needle sleeve which is located in a piston guide; the valve needle is movable relative to the needle sleeve; and the needle sleeve is movable relative to the piston guide; wherein the fuel injector comprises a first control chamber for controlling the position of the valve needle relative to the needle sleeve; and a second control chamber for controlling the position of the needle sleeve relative to the piston guide; a first nozzle control valve being provided for controlling the pressure in the first control chamber; and a second nozzle control valve being provided for controlling the pressure in the second control chamber.

The needle sleeve and the valve needle can be moved independently of each other within the piston guide. The valve needle can be moved in conjunction with or independently of the needle sleeve to control fuel delivery through said at least one nozzle outlet. The valve needle can be moved relative to the needle sleeve; and/or the needle sleeve can be moved relative to the piston guide. By controlling the valve needle and the needle sleeve, the fuel injector according to the present invention can be configured to provide different fuel injection rates. The fuel injector can be controlled to alter the size of the fuel injections into the combustion chamber, for example to provide large and small injections.

The valve needle and the needle sleeve can be arranged such that displacement of the needle sleeve causes the valve needle to move at least partway along the range of movement between said closed position and said open position. The needle sleeve can be movable through a range of movement between a retracted position and an advanced position. The valve needle can be at least partially located in the needle sleeve.

The valve needle can move in a first direction as it travels from said closed position to said open position. Conversely, the valve needle can move in a second direction as it travels from said open position to said closed position. In use, the valve needle and the needle sleeve can be displaced simultaneously or sequentially to displace the valve needle in said first direction and/or said second direction.

The valve needle can comprise a first valve for cooperating with the valve needle seat. The valve needle can also comprise a first contact surface for cooperating with a needle sleeve seat. The needle sleeve seat provides a lift-stop for the valve needle. The first contact surface can optionally form a seal with the needle sleeve seat. The first contact surface can thereby provide a second valve. The first valve can be provided at a first end of the valve needle and the second valve can be provided at a second end of the valve needle. When the second valve is seated in the needle sleeve seat, fuel leakage past the needle sleeve seat can be inhibited. This arrangement can be used in conjunction with a 3-way valve for controlling movement of the valve needle relative to the needle sleeve. A first aperture can be provided in the valve needle for providing a first fluid pathway past the needle sleeve seat. This arrangement can be used in conjunction with a 2-way valve for controlling movement of the valve needle relative to the needle sleeve.

The needle sleeve can have a second contact surface for cooperating with a piston guide seat. The piston guide seat can provide a lift-stop for the needle sleeve. The second contact surface can optionally form a seal with the piston guide seat. The second contact surface can thereby provide a third valve.

When the third valve is seated in the piston guide seat, fuel leakage past the piston guide seat can be inhibited. This arrangement can be used in conjunction with a 3-way valve for controlling movement of the needle sleeve relative to the piston guide. A second aperture can be provided in the piston guide for providing a second fluid pathway past the piston guide seat. This arrangement can be used in conjunction with a 2-way valve for controlling movement of the needle sleeve relative to the piston guide.

The valve needle can be displaced towards said closed position when the needle sleeve is advanced. Conversely, the valve needle can be displaced towards said open position when the needle sleeve is retracted. A sleeve spring can be provided for biasing the needle sleeve. The sleeve spring can be arranged to bias the needle sleeve towards an advanced position.

The valve needle and/or the sleeve guide could be displaced by an actuator. Alternatively, the valve needle and/or the sleeve guide can be controlled by fuel pressure in respective control chambers. A first control chamber is provided for controlling the position of the valve needle relative to the needle sleeve. A first nozzle control valve is provided for controlling the pressure in the first control chamber. A second control chamber is provided for controlling the position of the needle sleeve relative to the piston guide. A second nozzle control valve is provided for controlling the pressure in the second control chamber.

The first nozzle control valve and/or the second nozzle control valve can be in fluid communication with a high pressure fuel supply line. The first nozzle control valve and/or the second nozzle control valve can be in fluid communication with a low pressure fuel return line. The first nozzle control valve can be either a 2-way valve or a 3-way valve. The second nozzle control valve can be either a 2-way valve or a 3-way valve.

The lift of the valve needle could be the same as the lift of the guide sleeve. The distance traveled by the valve needle would, therefore, be the same when either the first or second control valves is actuated. This arrangement could, for example, provide an operating mode in which the valve needle is opened by the first control valve and closed by the second control valve (or vice versa). Alternatively, the lift of the valve needle could be greater or smaller than the lift of the guide sleeve. This arrangement would provide different lift states, for example first and second partial lift states and a third full lift condition.

In a further aspect, the present invention relates to a fuel injector comprising a nozzle having a movable valve needle for controlling fuel delivery through at least one nozzle outlet, the valve needle cooperating with a needle sleeve which is movably mounted in a piston guide.

In a still further aspect, the present invention relates to a method of operating a fuel injector, the fuel injector comprising a nozzle having a movable valve needle for controlling fuel delivery through at least one nozzle outlet, the valve needle cooperating with a needle sleeve which is movably mounted in a piston guide; the method comprising moving the valve needle and/or the needle sleeve to displace the valve needle with respect to said at least one nozzle outlet; wherein the method includes operating a first nozzle control valve to control an operating pressure in a first control chamber to control the position of the valve needle relative to the needle sleeve; and operating a second nozzle control valve to control an operating pressure in a second control chamber to control the position of the needle sleeve relative to the piston guide.

The valve needle can travel in a first direction when it is displaced to an open position; and a second direction when it is displaced to a closed position. The valve needle and the needle sleeve can be moved simultaneously or sequentially to displace the valve needle in said first direction. The valve needle and the needle sleeve can be moved simultaneously or sequentially to displace the valve needle in said second direction. The injection rate damping can be increased or decreased to alter the injection rate (at the beginning and/or at the end of an injection event). The injection rate damping can be controlled by moving the valve needle and the needle sleeve simultaneously or sequentially. The valve needle can be moved before the needle sleeve in the sequence; or the valve needle can be moved after the needle sleeve in the sequence. The sequence could be the same or reversed for the beginning and end of an injection event.

The method can include controlling an operating pressure in a first control chamber for controlling the position of the valve needle relative to the needle sleeve; and/or controlling an operating pressure in a second control chamber for controlling the position of the needle sleeve relative to the piston guide.

In a yet further aspect, the present invention relates to a fuel injector control unit configured to implement the method described herein. The fuel injector control unit can comprise one or more microprocessors for implementing the method.

In a yet further aspect, the present invention relates to a fuel injector for use in delivering fuel to an internal combustion engine, the fuel injector comprising: a nozzle having a valve needle which is movable with respect to a valve needle seat through a range of movement between a closed position and an open position to control fuel delivery through at least one nozzle outlet; the valve needle cooperating with a control member which is located in a piston guide;

the valve needle is movable relative to the control member; and the control member is movable relative to the piston guide; wherein the fuel injector comprises a first control chamber for controlling the position of the valve needle relative to the control member; and a second control chamber for controlling the position of the control member relative to the piston guide; a first nozzle control valve being provided for controlling the pressure in the first control chamber; and a second nozzle control valve being provided for controlling the pressure in the second control chamber.

In use, the valve needle can abut the control member to limit travel of the valve needle. The position of the control member can thereby control the lift of the valve needle, for example to define an intermediate lift position. The control member could be a sleeve in which the valve needle is partially disposed. Alternatively, the valve needle can be arranged to abut the control member, thereby controlling valve needle lift.

The first nozzle control valve and/or the second nozzle control valve can be selectively configured to place the respective first and second control chambers in fluid communication with a high pressure fuel supply line. A separate set of nozzle control valves could be provided for reducing the pressure in the first and second control chambers, for example selectively to connect the respective first and second control chambers to a low pressure drain. Alternatively, the first nozzle control valve and/or the second nozzle control valve can be configured selectively also to place the respective first and second control chambers in fluid communication with a low pressure fuel return line. The first nozzle control valve can be a two-way valve or a three-way valve. The second nozzle control valve can be a two-way valve or a three-way valve.

In a still further aspect, the present invention relates to a method of operating a fuel injector, the fuel injector comprising a nozzle having a movable valve needle for controlling fuel delivery through at least one nozzle outlet, the valve needle cooperating with a control member which is movably mounted in a piston guide; the method comprising actuating the valve needle and/or the control member to displace the valve needle with respect to said at least one nozzle outlet; wherein the method includes operating a first nozzle control valve to control an operating pressure in a first control chamber to control the position of the valve needle relative to the control member; and operating a second nozzle control valve to control an operating pressure in a second control chamber to control the position of the control member relative to the piston guide.

In a further aspect, the present invention relates to a fuel injector for use in delivering fuel to an internal combustion engine, the fuel injector comprising: a nozzle having a valve needle which is movable with respect to a valve needle seat through a range of movement between a closed position and an open position to control fuel delivery through at least one nozzle outlet; the valve needle cooperating with a needle sleeve which is located in a piston guide; wherein the valve needle is movable relative to the needle sleeve; and the needle sleeve is movable relative to the piston guide.

In a still further aspect, the present invention relates to a method of operating a fuel injector, the fuel injector comprising a nozzle having a movable valve needle for controlling fuel delivery through at least one nozzle outlet, the valve needle cooperating with a needle sleeve which is movably mounted in a piston guide; the method comprising moving the valve needle and/or the needle sleeve to displace the valve needle with respect to said at least one nozzle outlet.

The directional terms upper, lower, top, bottom, upwards and downwards are used herein with reference to the orientation of the fuel injector illustrated in the accompanying figures. These terms are not limiting on the operational configuration or orientation of the fuel injector according to the present invention.

BRIEF DESCRIPTION OF THE DRAWINGS

Embodiments of the present invention will now be described, by way of example only, with reference to the accompanying figures, in which.

DETAILED DESCRIPTION OF AN EMBODIMENT

Figure 1:
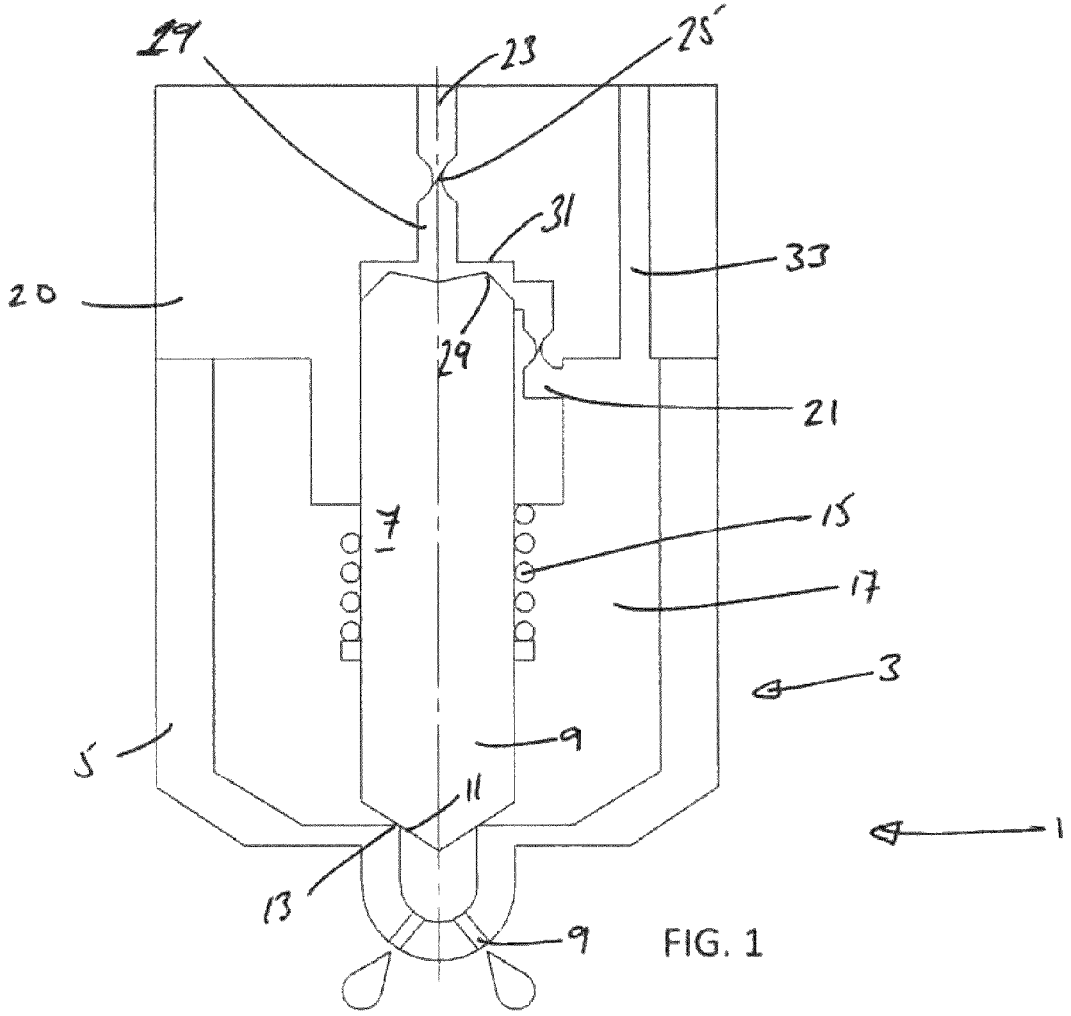
FIG. 1 shows a fuel injector having a valve needle movably mounted in a piston guide.
Figure 2:
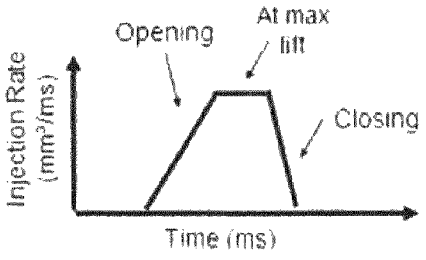
FIG. 2 shows an injection rate of the fuel injector of FIG. 1.
Figure 3:
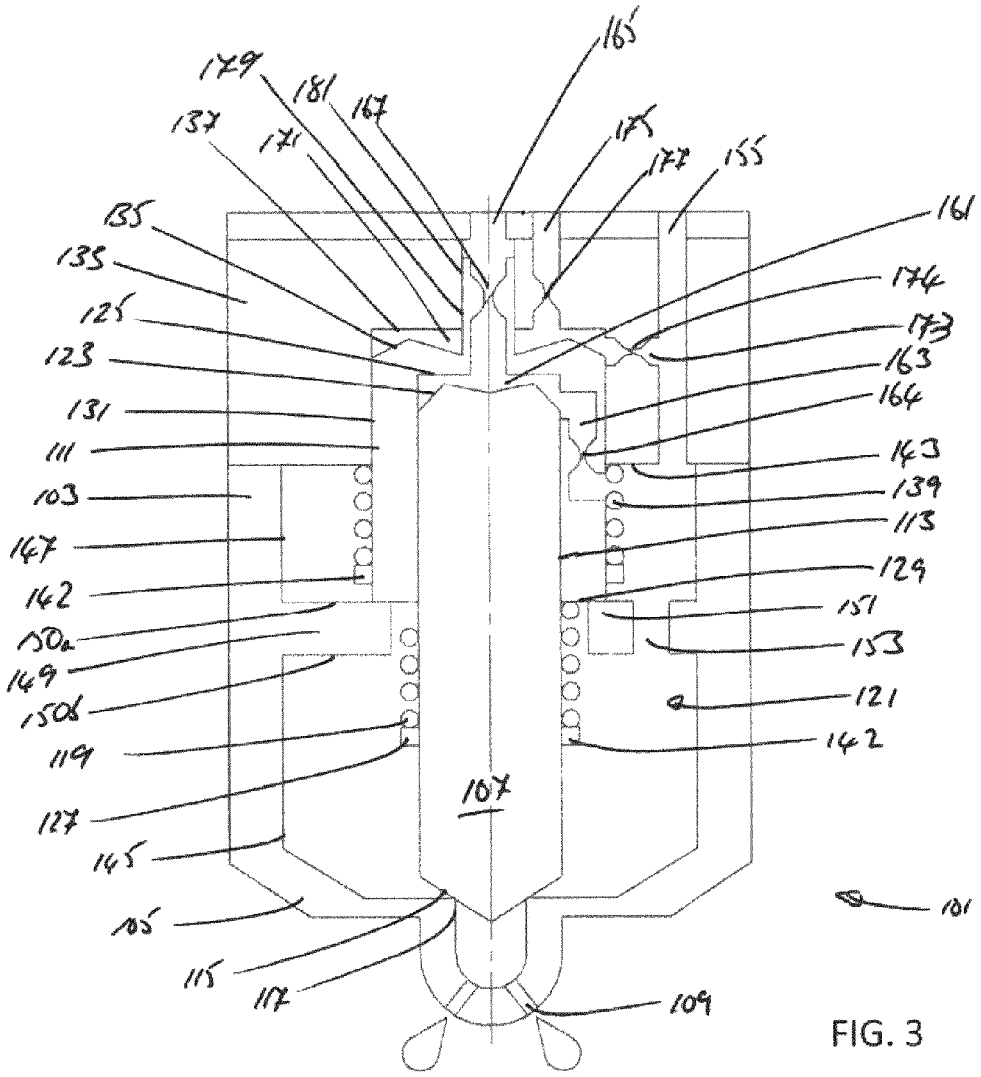
FIG. 3 shows a first embodiment of a fuel injector according to the present invention.

The present invention relates to a fuel injector 101 for supplying high pressure diesel fuel to a combustion chamber of an internal combustion engine (not shown). Embodiments of the present invention will be described with reference to FIGS. 3 to 8.

The fuel injector 101 comprises a nozzle body 103, an injector nozzle 105 and a movably mounted injector needle 107. The injector nozzle 105 comprises a plurality of nozzle holes 109 which can be selectively opened and closed by the injector needle 107 to inject fuel into a combustion chamber (not shown). An upper end of the injector needle 107 is located in a guide sleeve 111 which is movably mounted in the nozzle body 103.

The injector needle 107 is movable axially within a first guide bore 113 formed in the guide sleeve 111. The first guide bore 113 is a tight clearance on a guide portion of the injector needle 107 such that an outer outer circumference of the injector needle 107 abuts an inner circumference of the first guide bore 113 to guide the injector needle 107 throughout movement of the injector needle 107 relative to the guide sleeve 111. A lower needle valve 115 is formed at a bottom end of the injector needle 107 for cooperating with a lower valve seat 117 formed in the injector nozzle 5. A first spring 119 is provided in a first spring chamber 121 for biasing the injector needle 107 in a downwards direction to urge the lower needle valve 115 towards the lower valve seat 117. An upper needle valve 123 is formed at a top end of the injector needle 107 for cooperating with an upper valve seat 125 formed on an inner surface of the guide sleeve 111. A lower end of the first spring 119 is supported on a first spring seat 127 and a top end of the first spring 119 engages a lower end surface 129 of the guide sleeve 111.

The guide sleeve 111 is movable axially within a second guide bore 131 formed in a piston guide 133. The second guide bore 131 is a tight clearance on a guide portion of the guide sleeve 111. A sleeve valve 135 is formed at the top of the guide sleeve 111 for cooperating with a guide seat 137 formed in the piston guide 133. A second spring 139 is provided in a second spring chamber 141 for biasing the guide sleeve 111 in a downwards direction (thereby urging the lower needle valve 115 towards the lower valve seat 117). A lower end of the second spring 139 is supported by a second spring seat 142 and a top end of the second spring 139 engages a lower end surface 143 of the piston guide 133.

The first and second spring chambers 121, 141 are formed by respective first and second co-axial bores 145, 147 in the nozzle body 103. The first bore 145 has a smaller diameter than the second bore 147 and an annulus 149 is formed between the first and second bores 145, 147. The annulus 149 has an upper surface 150*a* and a lower surface 150*b*. The upper surface 150*a* of the annulus 149 forms a lift stop 151 for the guide sleeve 111. A fluid pathway 153 is provided in the annulus 149 to maintain fluid communication between the first spring chamber 121 and the second spring chamber 141.

A high pressure fuel supply line 155 supplies high pressure fuel from a fuel pump (P) to the injector nozzle 105, the first spring chamber 121 and the second spring chamber 141 which remain in fluid communication with each other. The fuel supply line 155 is also in fluid communication with first and second control valves 157, 159 arranged to control the operation of the fuel injector 101, as shown schematically in FIG. 4. In the present embodiment, the first and second control valves 157, 159 are three-way valves which can be actuated independently by separate electromechanical solenoids. The first and second control valves 157, 159 are configured such that energising one or both of the solenoids causes the injector needle 107 to lift from the lower valve seat 117 and inject fuel into the combustion chamber. However, it will be appreciated that the first and second control valves 157, 159 could be configured such that de-energising one or both of the solenoids causes the injector needle 107 to lift from the lower valve seat 117.

A first control chamber 161 is defined between the injector needle 107 and the guide sleeve 111 for controlling the position of the injector needle 107 relative to the guide sleeve 111. A first inlet orifice 163 having a first inlet throttle 164 is provided in the guide sleeve 111 to provide a fluid pathway from the fuel supply line 155 to the first control chamber 161 (via the second spring chamber 141). The upper needle valve 123 opens and closes the fluid pathway to the first control chamber 161. When the upper needle valve 123 is seated in the upper valve seat 125, the fluid pathway is closed and fluid communication past the upper valve seat 125 is broken. Conversely, when the upper needle valve 123 is unseated, the fluid pathway is open and fluid communication between the fuel supply line 155 and the first control chamber 161 is permitted.

Figure 4:
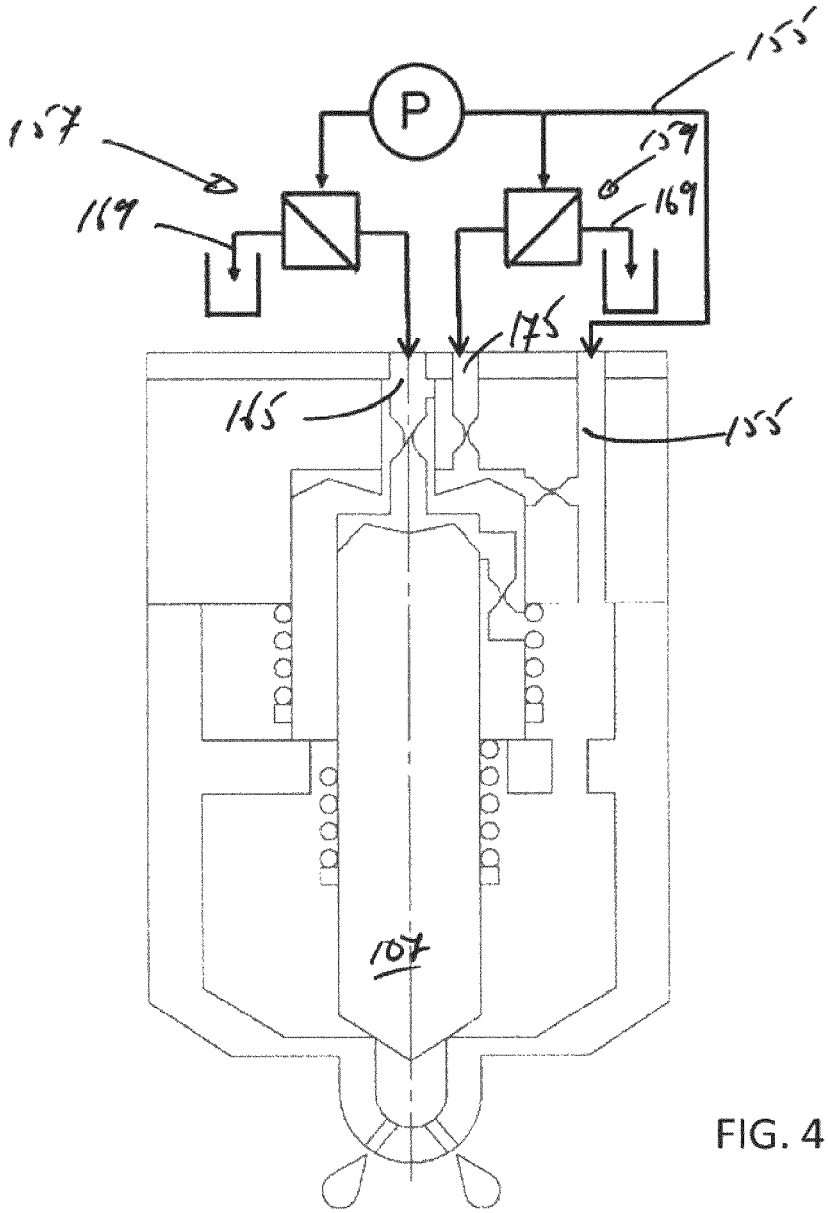
FIG. 4 shows a schematic representation of the control valves for the fuel injector according to the first embodiment of the present invention.

A first control line 165, having a first restricted orifice 167, forms an axial fluid pathway from the first control chamber 161 to the first control valve 157. The first control valve 157 is configured to selectively place the first control chamber 161 in fluid communication with either the fuel supply line 155 or a low pressure fuel return line 169. The first control valve 157 is illustrated in FIG. 4 in a state in which the first control chamber 161 is in fluid communication with the fuel supply line 155 and, therefore, is fully pressurised. Operating the first control valve 157 to place the first control chamber 161 in fluid communication with the fuel return line 169 de-pressurises the first control chamber 161.

A second control chamber 171 is defined between the guide sleeve 111 and the piston guide 133 for controlling the position of the guide sleeve 111 relative to the piston guide 133. A second inlet orifice 173 having a second inlet throttle 174 is provided in the piston guide 133 to provide a fluid pathway from the fuel supply line 155 to the second control chamber 171 (via the second spring chamber 141). The sleeve valve 135 opens and closes the fluid pathway to the second control chamber 171. When the sleeve valve 135 is seated in the guide seat 137, the fluid pathway is closed and fluid communication between the fuel supply line 155 and the second control chamber 171 is broken. Conversely, when the sleeve valve 135 is unseated, the fluid pathway is open and fluid communication between the fuel supply line 155 and the second control chamber 171 is permitted.

A second control line 175, having a second restricted orifice 177, forms an angularly offset fluid pathway from the second control chamber 171 to the second control valve 159. The second control valve 159 is configured to selectively place the second control chamber 171 in fluid communication with either the fuel supply line 155 or the low pressure fuel return line 169. The second control valve 159 is illustrated in FIG. 4 in a state in which the second control chamber 171 is in fluid communication with the fuel supply line 155 and, therefore, is fully pressurised. Operating the second control valve 159 to place the second control chamber 171 in fluid communication with the fuel return line 169 de-pressurises the second control chamber 171.

An end guide 179 is provided at the top of the guide sleeve 111 and locates in an end guide bore 181 formed in the guide piston 133. The end guide 179 is a tight clearance in the end guide bore 181 to reduce leakage past the end guide 179. The first control line 165 extends axially along the end guide 179.

The fuel injector 101 according to the present invention enables the injector needle 107 and the guide sleeve 111 to move independently of each other. The control valves 157, 159 can be operated to cause the injector needle 107 and the guide sleeve 111 to be displaced simultaneously or sequentially. The control of the injector needle 107 and the guide sleeve 111 will now be described.

When the first control valve 157 is actuated to place the first control chamber 161 in fluid communication with the fuel supply line 155 (and fluid communication with the fuel return line 169 is broken), the fuel pressure in the injector nozzle 105 and the first control chamber 161 equalises and the first spring 119 biases the injector needle 107 downwardly such that the lower needle valve 115 is displaced towards the lower valve seat 117.

When the first control valve 157 is operated to place the first control chamber 161 in fluid communication with the fuel return line 169 (and fluid communication with the fuel supply line 155 is broken), the fuel pressure in the first control chamber 161 falls below the fuel pressure in the injector nozzle 105. A pressure force is applied to the injector needle 107 which overcomes the bias of the first spring 119 and the injector needle 107 is displaced upwardly lifting the lower needle valve 115 from the lower valve seat 117. The upper needle valve 123 seats in the upper valve seat 125 thereby preventing fluid communication past the upper valve seat 125.

When the second control valve 159 is operated to place the second control chamber 171 in fluid communication with the fuel supply line 155 (and fluid communication with the fuel return line 169 is broken), the fuel pressure in the first control chamber 161 and the second control chamber 171 equalises and the second spring 139 biases the guide sleeve 111 downwardly against the lift stop 151. The injector needle 107 is displaced downwardly with the guide sleeve 111.

When the second control valve 159 is operated to place the second control chamber 171 in fluid communication with the fuel return line 169 (and fluid communication with the fuel supply line 155 is broken), the fuel pressure in the second control chamber 171 falls below the fuel pressure in the first control chamber 161. A pressure force is applied to the guide sleeve 111 which overcomes the bias of the second spring 139 and the guide sleeve 111 is displaced upwardly. The sleeve valve 135 seats in the guide seat 137 thereby preventing fluid communication past the guide seat 137. The injector needle 107 travels with the guide sleeve 111 and the lower needle valve 115 lifts from the lower valve seat 117.

In use, the first and second control valves 157, 159 can be operated to provide the following operating modes:

(i) The first control valve 157 is actuated to place the first control chamber 161 in fluid communication with the fuel return line 169 to displace the injector needle 107 relative to the guide sleeve 111 followed by actuation of the second control valve 159 to place the second control chamber 171 in fluid communication with the fuel return line 169 to displace the guide sleeve 111 relative to the piston guide 133;

(ii) The second control valve 159 is actuated to place the second control chamber 171 in fluid communication with the fuel return line 169 to displace the guide sleeve 111 relative to the piston guide 133 followed by actuation of the first control valve 157 to place the first control chamber 161 in fluid communication with the fuel return line 169 to displace the injector needle 107 relative to the guide sleeve 111;

(iii) The first and second control valves 157, 159 are actuated simultaneously to place both the first and second control chambers 161, 171 in fluid communication with the fuel return line 169 to displace the injector needle 107 and the guide sleeve 111 together; or (iv) Only one of the first and second control valves 157, 159 is actuated to place either the first control chamber 161 or the second control chamber 171 in fluid communication with the fuel return line 169 (so that maximum lift of the injector needle 107 is not obtained during the injection event).

Any combination of the above operating sequences can be implemented. Moreover, the operating sequences can be implemented to advance or retract the injector nozzle 107. Thus, one or more of the opening, steady-state and closing injection rate can be controlled by the fuel injector 101.

Figures 5A, 5B:
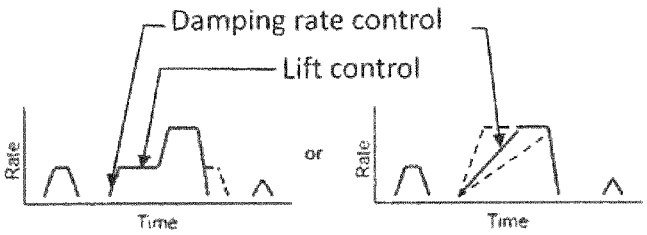
FIGS. 5*a* and 5*b* show exemplary injection rates provided by the fuel injector according to the first embodiment of the present invention.

By way of example, two different rate shapes implemented by controlled operation of the fuel injector 101 according to the present invention are illustrated in FIGS. 5*a* and 5*b*. FIG. 5*a* shows a 'reverse boot injection' where fuel is injected at a very low rate at the end of the main injection (where the injector needle 107 goes to a small steady state lift). Traditionally, a small injection after the end of the main injection would normally be done with a 'close coupled post injection', but it is very difficult to get a small separation due to valve delays. What would normally happen as the post injection got closer to the main injection is that it would become very unstable as the injections start to blend into one.

FIG. 5*b* illustrates how the present invention enables the damping rate of the injector needle 107 to be altered. The first and second control valves 157, 159 can be actuated simultaneously or independently, meaning that the velocity of the injector needle 107 (relative to the nozzle body 103) can be altered, and thus the injection rate damping can be increased or decreased. The injection rate can be changed both at the beginning or end of an injection event (although FIG. 5*b* just shows the different injection rates at the front of the main injection). The damping rate can be altered without changing the orifice geometry and, therefore, can be changed whilst injecting and during engine running.

The operating modes of the first and second control valves 157, 159 provide three different steady-state lift states for the injector needle 107, namely:

Lift State 1—Only the first control valve 157 is open;

Lift State 2—Only the second control valve 159 is open; and

Lift State 3—Both the first and second control valves 157, 159 are open.

This control flexibility can also be applied to the closing portion of the injection (again with a large number of options/permutations). Consequently, a large number of different injection rate profiles can be produced. The different operating modes can be selected whilst the engine is operating. The rate shape can also be changed from injection to injection, including selection of a different rate shape between pilot, main and post injections.

Figure 6:
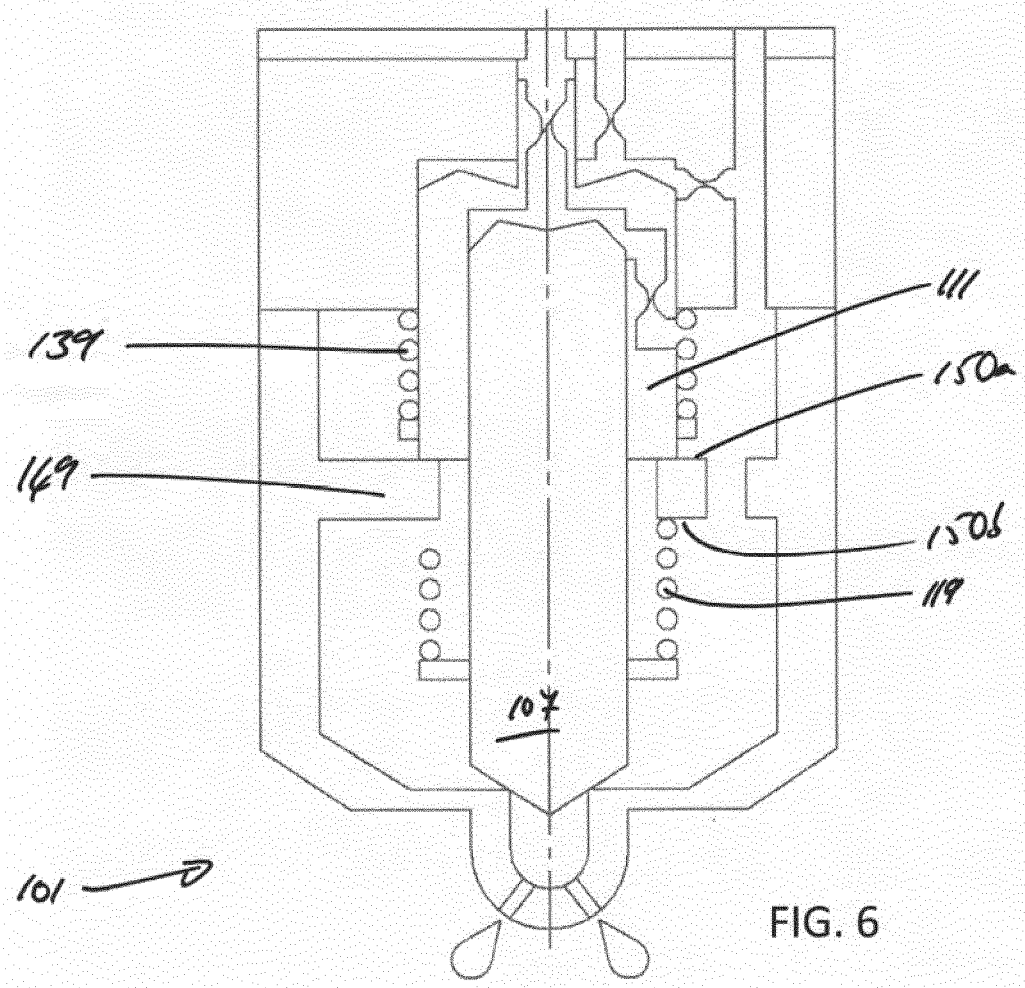
FIG. 6 shows a modified arrangement of the fuel injector according to the first embodiment of the present invention.

The fuel injector 101 according to the present embodiment can be modified to change the mounting arrangement of the first spring 119. As shown in FIG. 6, the top end of the first spring 119 can be arranged to engage the lower surface 150*b* of the annulus 149. This arrangement can provide different operating characteristics for the fuel injector 101. Notably, the biasing force provided by the first spring 119 will change depending on the position of the sleeve guide 111.

Figure 7:
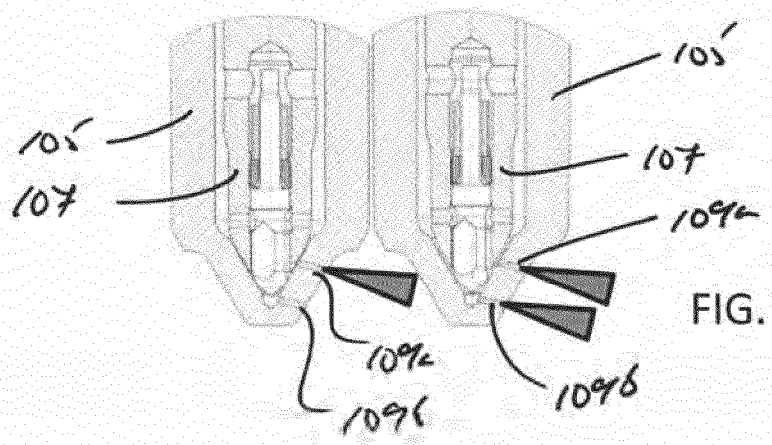
FIG. 7 shows a variable orifice fuel injector nozzle for use with the fuel injector according to the present invention.

The design of the needle tip and the needle seat within the nozzle body can be similar to that used in existing designs (Hemisac, Conical Sac and VCO—Valve Covers Orifice), or a more complicated arrangement can be applied such as the Applicant's VON (Variable Orifice Nozzle) design. The VON designs make it possible to uncover two different sets of nozzle holes during the portions of the needle lift. By way of example, a pair of fuel injectors 101 incorporating a VON design is illustrated in FIG. 7. First and second sets of axially displaced nozzle holes 109*a*, 109*b* are provided which can be opened sequentially depending on the lift position of the injector needle 107. As shown in the injector nozzle 105 on the left, only the first set of nozzle holes 109*a* is open when the injector needle 107 is in a first (partial) lift position. As shown in the injector nozzle 105 on the right, both the first and second sets of nozzle holes 109*a*, 109*b* are open when the injector needle 107 is in a second (full) lift position. The VON design is described in more detail in the Applicant's European patent EP 1626173 B1 and U.S. Pat. No. 7,599,488 B2, the contents of these documents are expressly incorporated herein in their entirety by reference.

The type and design of the first and second control valves 157, 159 used to control the fuel injector 101 are flexible and a variety of valve combinations can be utilised. The fuel injector 101 can be modified to utilise a 2-way valve for the first control valve 157 and/or the second control valves 159. When using a 2-way valve in the circuit, the arrangement of the filling orifices needs to be modified as the first control chamber 161 and/or the second control chamber 171 will not be filled from the 2-way valve (as it is not connected to the fuel supply line 155). Rather, the filling orifice of the associated control chamber(s) 161, 171 will be constantly fed with fuel from the fuel supply line 155. The use of two 3-way valves (as described above) avoids the need for constant filling.

Embodiments of the fuel injector 101 for use in conjunction with one or more 2-way control valves 161, 171 will now be described with reference to FIGS. 8*a-c*. These embodiments are modified versions of the first embodiment and like reference numerals will be used for like components. The first and second control valves 157, 159 are illustrated in FIGS. 8*a-c* in the state in which the first and second control chambers 161, 171 are fully pressurised.

Figure 8A:
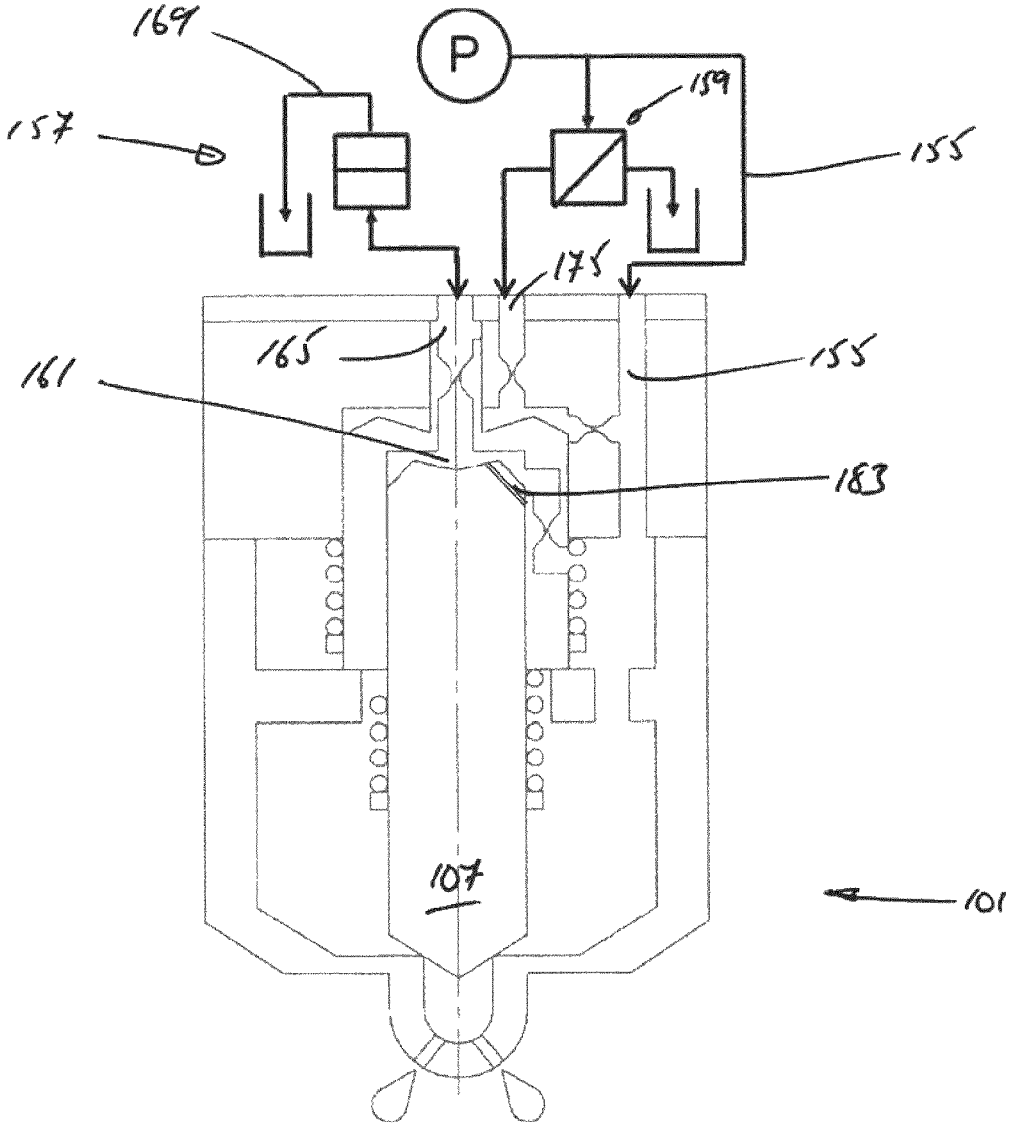
FIGS. 8*a-c* show second, third and fourth embodiments of the fuel injector according to the present invention.

As shown in FIG. 8*a*, in a second embodiment the first control valve 157 is a 2-way valve and the second control valve 159 a 3-way valve. The first control valve 157 is configured to selectively open and close a fluid pathway from the first control chamber 161 to the fuel return line 169. The second control valve 159 is unchanged from the first embodiment described herein. When the first control valve 157 is open, the first control chamber 161 is in fluid communication with the fuel return line 169 and the first control chamber 161 is de-pressurised. Conversely, when the first control valve 157 is closed, the fluid communication is broken. The injector needle 107 is modified to provide a needle injector bore 183 for establishing fluid communication past the upper valve seat 125 to allow the first control chamber 161 to re-pressurise after the first control valve 157 is closed and fluid communication between the first control chamber 161 and the fuel return line 169 is broken.

Figure 8B:
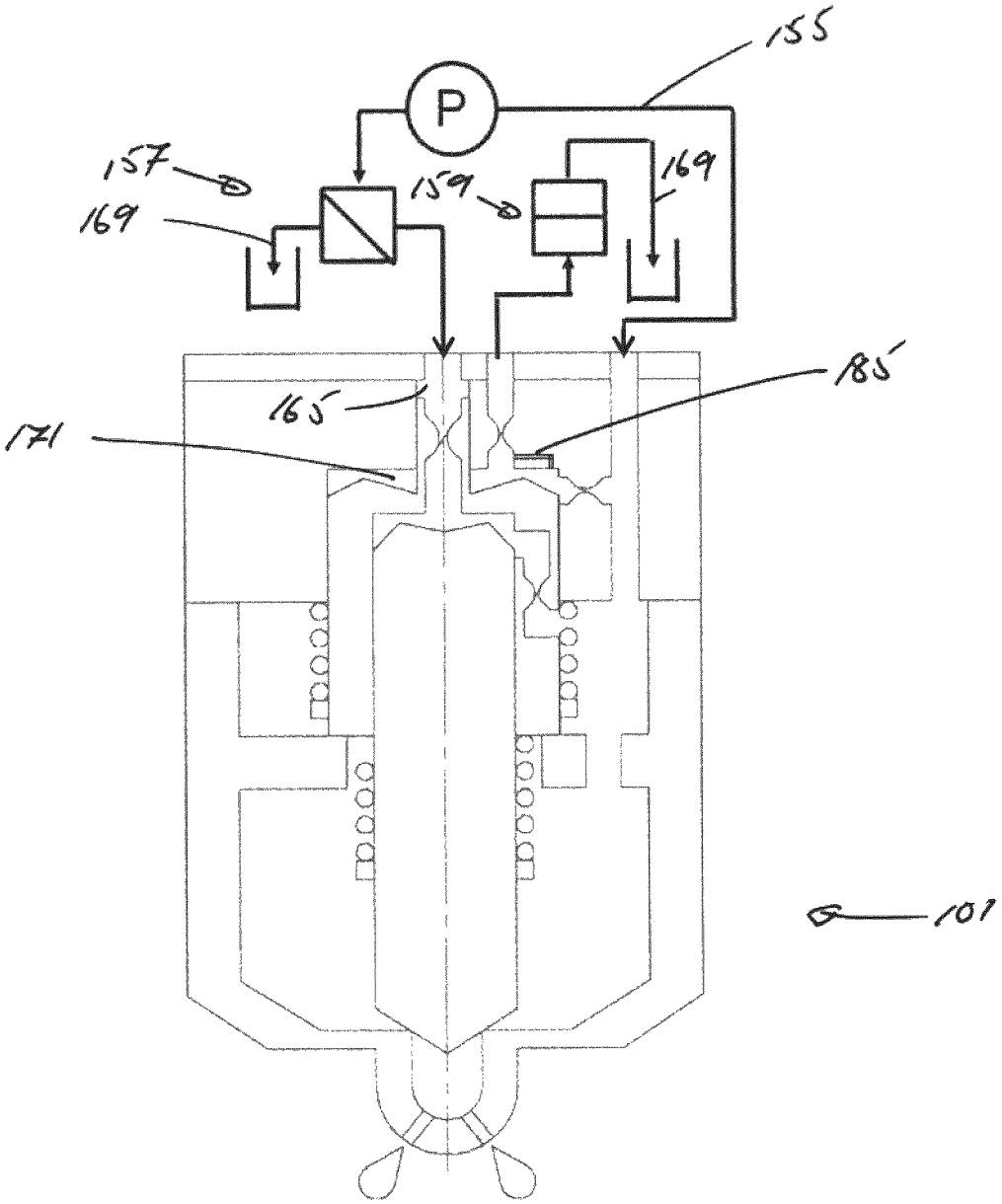

As shown in FIG. 8*b*, in a third embodiment the first control valve 157 is a 3-way valve and the second control valve 159 a 2-way valve. The first control valve 157 is unchanged from the first embodiment described herein. The second control valve 159 is configured to selectively open and close a fluid pathway from the second control chamber 171 to the fuel return line 169. When the second control valve 159 is open, the second control chamber 171 is in fluid communication with the fuel return line 169 and the second control chamber 171 is de-pressurised. Conversely, when the second control valve 159 is closed, the fluid communication is broken. The piston guide 133 is modified to provide a piston guide bore 185 for establishing fluid communication past the guide seat 137 to allow the second control chamber 171 to re-pressurise after the second control valve 159 is closed and fluid communication between the second control chamber 171 and the fuel return line 169 is broken.

Figure 8C:
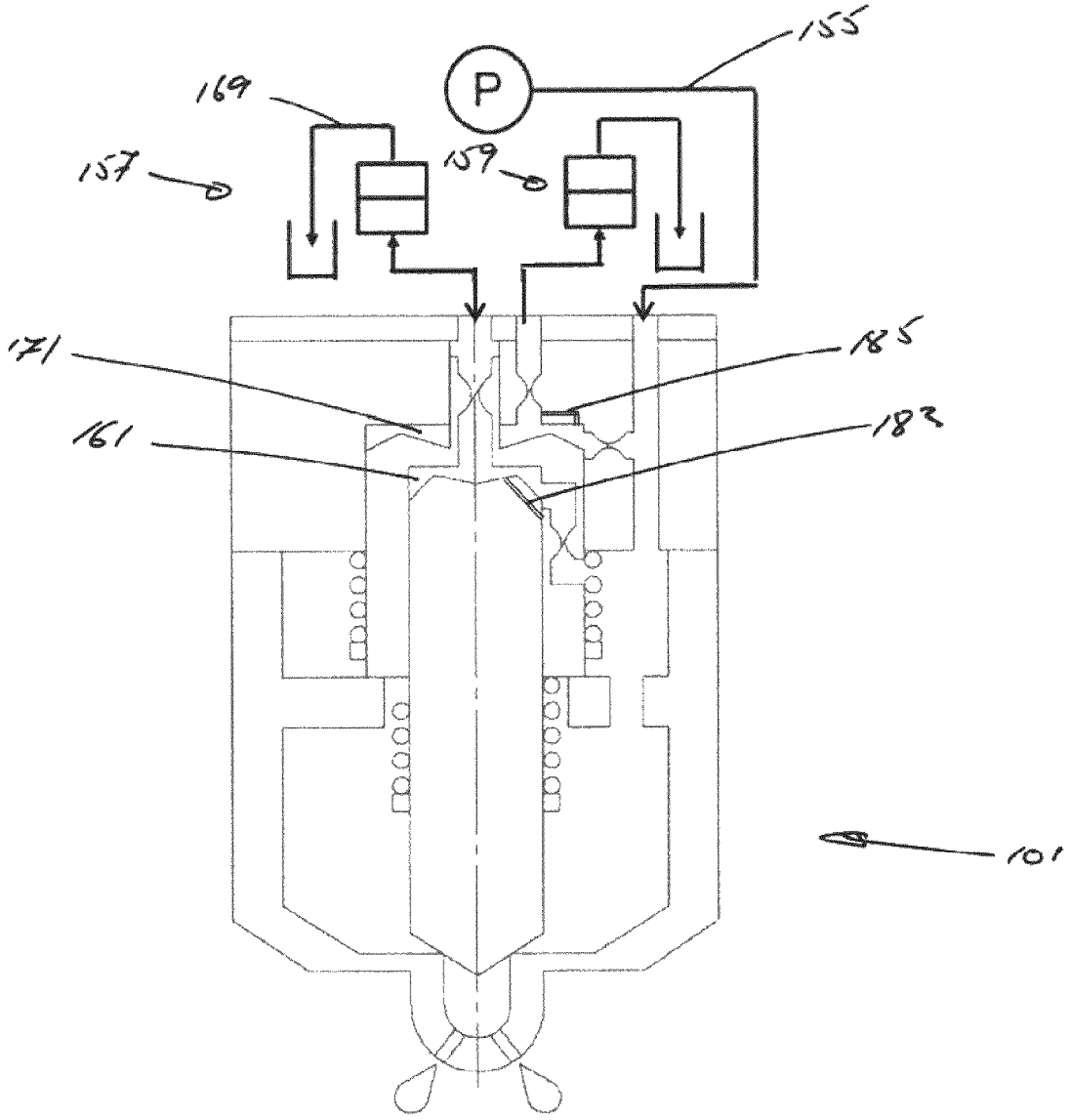

As shown in FIG. 8*c*, in a fourth embodiment the first control valve 157 is a 2-way valve and the second control valve 159 a 2-way valve. The first control valve 157 is configured to selectively open and close a fluid pathway from the first control chamber 161 to the fuel return line 169. The second control valve 159 is configured to selectively open and close a fluid pathway from the second control chamber 171 to the fuel return line 169. The injector needle 107 is modified to provide a needle injector bore 183 for establishing fluid communication past the upper valve seat 125 to allow the first control chamber 161 to re-pressurise after the first control valve 157 is closed and fluid communication between the first control chamber 161 and the fuel return line 169 is broken. Similarly, the piston guide 133 is modified to provide a piston guide bore 185 for establishing fluid communication past the guide seat 137 to allow the second control chamber 171 to re-pressurise after the second control valve 159 is closed and fluid communication between the second control chamber 171 and the fuel return line 169 is broken.

The operation of the second, third and fourth embodiments of the fuel injector 101 are unchanged from the first embodiment described herein.

Figure 9:
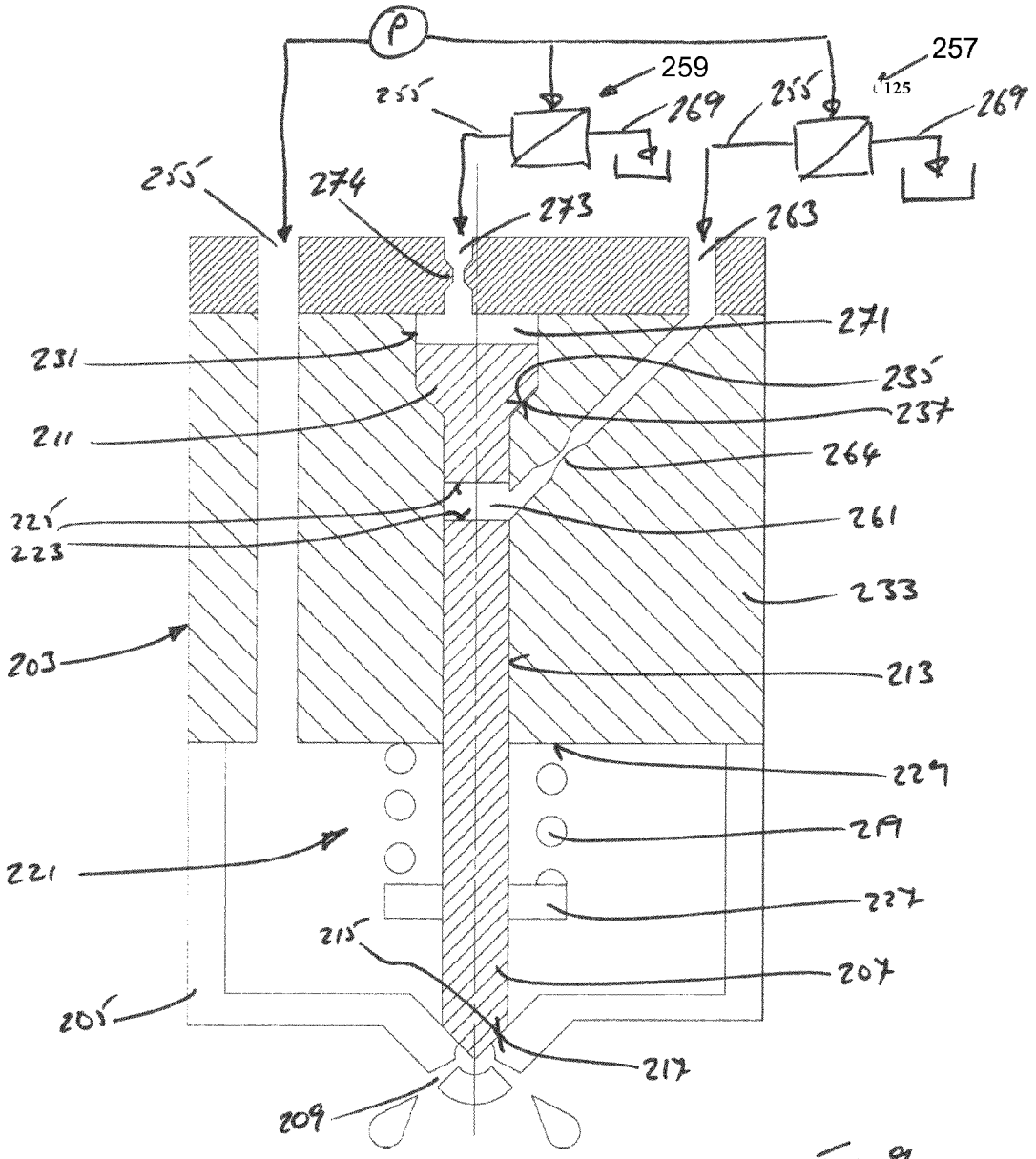
FIG. 9 shows a fifth embodiment of the fuel injector according to the present invention.

A fuel injector 201 according to a fifth embodiment of the present invention will now be described with reference to FIGS. 9 and 10. Like reference numerals are used for like components, albeit incremented by 100 to aid clarity.

The fuel injector 201 comprises a nozzle body 203, an injector nozzle 205 and a movably mounted injector needle 207. The injector nozzle 205 comprises a plurality of nozzle holes 209 which can be selectively opened and closed by the injector needle 207 to inject fuel into a combustion chamber (not shown). An upper end of the injector needle 207 selectively cooperates with a control member 211 which is movably mounted in the nozzle body 203.

The injector needle 207 is movable axially within a first guide bore 213 formed in a nozzle guide 233. The first guide bore 213 is a tight clearance on a guide portion of the injector needle 207. A lower needle valve 215 is formed at a bottom end of the injector needle 207 for cooperating with a lower valve seat 217 formed in the injector nozzle 205. A first spring 219 is provided in a first spring chamber 221 for biasing the injector needle 207 in a downwards direction to urge the lower needle valve 215 towards the lower valve seat 217. An upper needle seat 223 is formed at a top end of the injector needle 207 for cooperating with an upper valve seat 225 defined by a lower surface of the control member 211. A lower end of the first spring 219 is supported on a first spring seat 227 and a top end of the first spring 219 engages a lower end surface 229 of the nozzle guide 233.

The control member 211 is movable axially within a second guide bore 231 formed in the nozzle body 203. The second guide bore 231 is a tight clearance on a guide portion of the control member 211. The control member 211 comprises a control member valve 235 for cooperating with a guide seat 237 formed in the nozzle body 203.

A high pressure fuel supply line 255 supplies high pressure fuel from a fuel pump (P) to the injector nozzle 205 and into the first spring chamber 221. The fuel supply line 255 is also selectively in fluid communication with first and second control valves 257, 259 arranged to control the operation of the fuel injector 201, as shown schematically in FIGS. 10A-C. In the present embodiment, the first and second control valves 257, 259 are three-way valves which can be actuated independently by separate electromechanical solenoids. The first and second control valves 257, 259 are configured such that energising one or both of the solenoids causes the injector needle 207 to lift from the lower valve seat 217 and inject fuel into the combustion chamber. However, it will be appreciated that the first and second control valves 257, 259 could be configured such that de-energising one or both of the solenoids causes the injector needle 207 to lift from the lower valve seat 217.

A first control chamber 261 is formed in the first guide bore 213 between the injector needle 207 and the control member 211. The first control chamber 261 is configured to control the position of the injector needle 207 relative to the control member 211. A first inlet orifice 263 having a first inlet throttle 264 is provided in the nozzle body 203 to provide a fluid pathway from the fuel supply line 255 to the first control chamber 261. The first control valve 257 is operable selectively to supply fuel to the first control chamber 261 from the high pressure fuel supply line 255 or to exhaust fuel from the first control chamber 261 to a fuel return line 269.

A second control chamber 271 is formed in the piston guide 233 above the control member 211. The second control chamber 271 is configured to control the position of the control member 211. A second inlet orifice 273 having a second inlet throttle 274 is provided in the piston guide 233 to provide a fluid pathway from the fuel supply line 255 to the second control chamber 271. The second control valve 259 is operable selectively to supply fuel to the second control chamber 271 from the high pressure fuel supply line 255 or to exhaust fuel from the second control chamber 271 to the fuel return line 269.

The fuel injector 201 according to the fifth embodiment of the present invention enables the injector needle 207 and the control member 211 to move independently of each other. The first and second control valves 257, 259 can be operated to cause the injector needle 207 and the control member 211 to be displaced simultaneously or sequentially. The control of the injector needle 207 and the control member 211 will now be described with reference to FIGS. 10A-C. The high pressure fuel within the first and second control chambers 261, 271 is illustrated by a solid block colour in these schematic drawings.

Figure 10C:
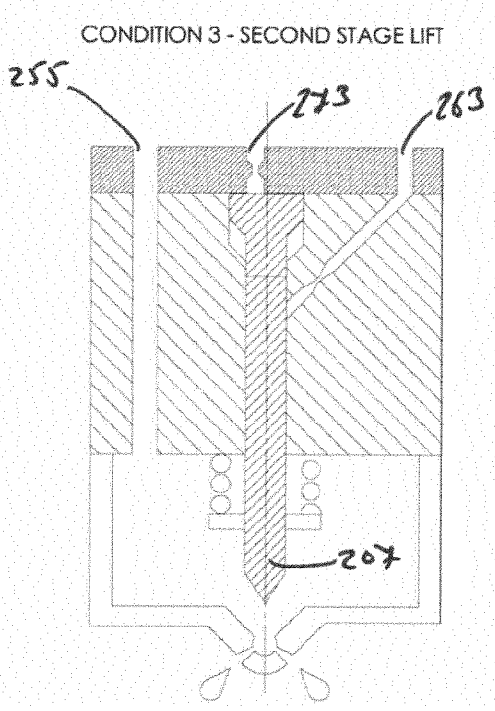
FIGS. 10A-C illustrate the operating modes of the fuel injector according to the second embodiment of the present invention.
Figure 10B:
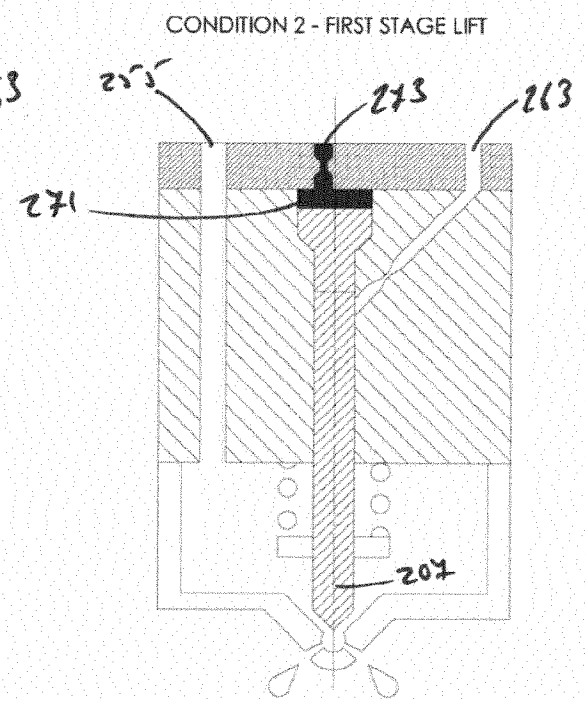
Figure 10A:
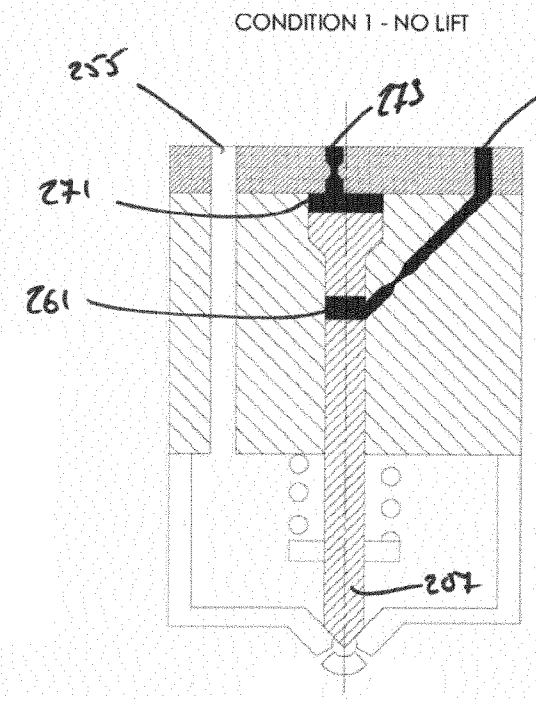

With reference to FIG. 10A, when the first and second control valves 257, 259 are actuated to place the first and second control chamber 261, 271 in fluid communication with the fuel supply line 255, the fuel pressure in the first and second control chambers 261, 271 equalises with the fuel pressure in the injector nozzle 205. The first spring 219 biases the injector needle 207 downwardly such that the lower needle valve 215 is displaced towards the lower valve seat 217.

With reference to FIG. 10B, when the first control valve 257 is operated to place the first control chamber 261 in fluid communication with the fuel return line 269, the fuel pressure in the first control chamber 261 drops below the fuel pressure in the injector nozzle 205. A pressure force is applied to the injector needle 207 which overcomes the bias of the first spring 219 and the injector needle 207 is displaced upwardly lifting the lower needle valve 215 from the lower valve seat 217. The injector needle 207 lifts until the upper needle valve 223 abuts against the control member 211. The injector needle 207 is thereby displaced to a first lift position determined by the control member 211.

In the present embodiment, the first and second control valves 257, 259 are both 3-way valves which can be selectively operated to place the respective first and second control chambers 261, 271 in communication with either the fuel supply line 255 or the fuel return line 269. The fuel injector 201 could include separate valves operable selectively to place the respective first and second control chambers 261, 271 in communication with the fuel return line 269.

With reference to FIG. 10C, when the second control valve 259 is operated to place the second control chamber 271 in fluid communication with the fuel return line 269, the fuel pressure in the second control chamber 271 drops below the fuel pressure in the injector nozzle 205 and the injector needle 207 and the control member 211 are displaced upwardly together (i.e. in concert with each other). The injector needle 207 is thereby displaced to a second lift position.

In use, the first and second control valves 257, 259 can be operated to provide the following operating modes:

(i) The first control valve 257 is actuated to place the first control chamber 261 in fluid communication with the fuel return line 269 to displace the injector needle 207 relative to the control member 211 to an intermediate lift position; and then the second control valve 259 is actuated to place the second control chamber 271 in fluid communication with the fuel return line 269 to displace both the control member 211 and the injector needle 207 thereby displacing the injector needle 207 to a full lift position;

(ii) The second control valve 259 is actuated to place the second control chamber 271 in fluid communication with the fuel return line 269 to displace the control member 211 relative to the piston guide 233 to an intermediate lift position; and then the first control valve 257 is actuated to place the first control chamber 261 in fluid communication with the fuel return line 269 to displace the injector needle 207 to a full lift position in which it abuts the control member 211;

(iii) The first and second control valves 257, 259 are actuated simultaneously to place the first and second control chambers 261 in fluid communication with the fuel return line 269 to displace the injector needle 207 and the control member 211 together to a full lift position; or (iv) Only the first control valve 257 is actuated to place the first control chamber 261 in fluid communication with the fuel return line 269 to displace the injector needle to an intermediate lift position (so that maximum lift of the injector needle 207 is not obtained during the injection event).

Any combination of the above operating sequences can be implemented. Moreover, the operating sequences can be implemented to advance or retract the injector nozzle 207. Thus, one or more of the opening, steady-state and closing injection rate can be controlled by the fuel injector 201.

The fuel injector 201 has been described with reference to first and second control valves 257, 259 which are 3-way valves. In an alternate arrangement, one or both of the first and second control valves 257, 259 could be a 2-way valve. For example, a first inlet bore could be provided for supplying a constant pressure fuel feed to the first control chamber 261; and/or a second inlet bore could be provided for supplying a constant pressure fuel feed to the second control chamber 271. In this arrangement, the outlet orifice from the first and/or second control chambers 261, 271 should be larger than the respective inlet orifice 263, 273. The first control valve 257 and/or the second control valve 259 could be a 2-way valve to control the pressure in the respective first and second control chambers 261, 271.

Figure 11A:
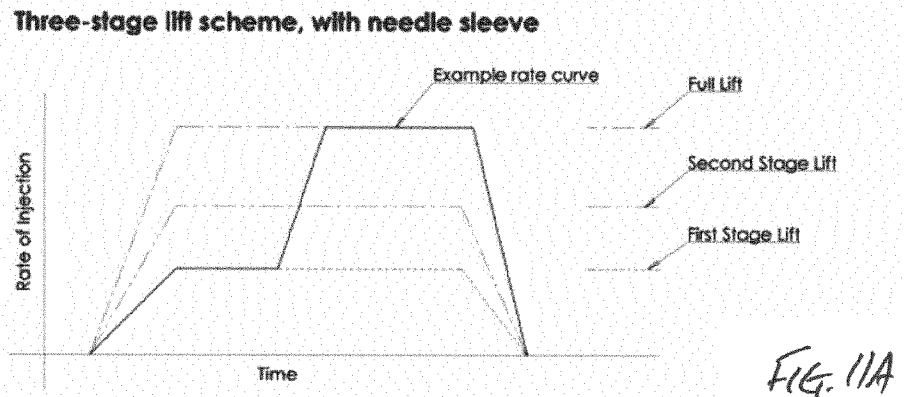
FIGS. 11A and 11B show injection rate charts for the fuel injectors according to the first and fifth embodiments of the present invention.
Figure 11B:
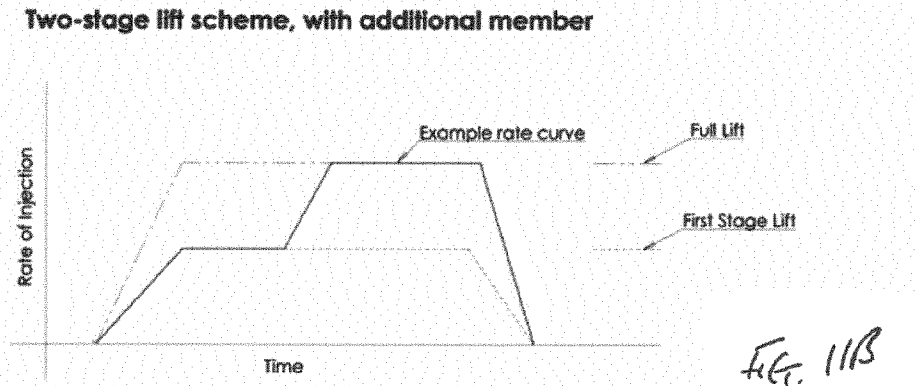

A typical injection chart for the fuel injector 101 according to the first embodiment of the present invention is shown in FIG. 11A; and a typical injection chart for the fuel injector 201 according to the fifth embodiment of the present invention is shown in FIG. 11B.

With reference to FIG. 11A, the injector needle 107 can be displaced to three lift positions: a first intermediate lift position, a second intermediate lift position and a full lift position. The injector needle 107 and the guide sleeve 111 can be configured to define different lift ranges, thereby enabling the injector needle 107 to be lifted to either the first or second intermediate lift positions. The injector needle 107 can be displaced to either the first intermediate lift position or the second intermediate lift position by controlling the sequence in which the first and second control valves 157, 159 operate to lift the injector needle 107 and the guide sleeve 111.

With reference to FIG. 11B, the injector needle 207 can be displaced to two lift positions: a first intermediate lift position and a full lift position. The first intermediate lift position is determined by the configuration of the control member 211 which defines a stop position for the injector needle 107. The injector needle 207 can be displaced to said first intermediate lift position by actuating the first control valve 257 to place the first control chamber 261 in fluid communication with the fuel return line 269. The injector needle 207 can subsequently be displaced to the full lift position by actuating the second control valve 259 to place the second control chamber 271 in fluid communication with the fuel return line 269. The first and second control valves 257, 259 can be actuated sequentially or simultaneously.

It will be appreciated that various changes and modifications can be made to the embodiment described herein without departing from the scope of the present invention. For example, the actuator for operating the first and second control valves 161, 171 can comprise a piezoelectric stack.

The invention claimed is:

1. A fuel injector for use in delivering fuel to an internal combustion engine, the fuel injector comprising:

a nozzle having a valve needle which is movable with respect to a valve needle seat through a range of movement between a closed position and an open position to control fuel delivery through at least one nozzle outlet;

the valve needle cooperating with a needle sleeve which is located in a piston guide; the needle sleeve having a guide bore which receives a guide portion of the valve needle such that an outer circumference of the valve needle abuts an inner circumference of the guide bore to guide the valve needle throughout movement of the valve needle relative to the needle sleeve; the valve needle is movable relative to the needle sleeve; and the needle sleeve is movable relative to the piston guide;

wherein the fuel injector comprises a first control chamber for controlling the position of the valve needle relative to the needle sleeve; and a second control chamber for controlling the position of the needle sleeve relative to the piston guide;

wherein movement of the valve needle with respect to the valve needle seat, toward the open position, is limited by the needle sleeve;

a first nozzle control valve being provided for controlling the pressure in the first control chamber; and a second nozzle control valve being provided for controlling the pressure in the second control chamber wherein the valve needle comprises a first valve for cooperating with the valve needle seat and a first contact surface for cooperating with a needle sleeve seat such that a fluid pathway from the first control chamber is open when the first contact surface is unseated from the needle sleeve seat and such that the fluid pathway from the first control chamber is closed when the first contact surface is seated with the needle sleeve seat.

2. A fuel injector as claimed in claim 1, wherein the needle sleeve is movable through a range of movement between a retracted position and an advanced position.

3. A fuel injector as claimed in claim 1, wherein the valve needle and the needle sleeve are movable together or independently of each other.

4. A fuel injector as claimed in claim 1, wherein the first contact surface forms a second valve for sealingly engaging the needle sleeve seat.

5. A fuel injector as claimed in claim 4, wherein the valve needle further comprises a first aperture for providing a first fluid pathway past the needle sleeve seat.

6. A fuel injector as claimed in claim 1, wherein the needle sleeve has a second contact surface for cooperating with a piston guide seat.

7. A fuel injector as claimed in claim 6, wherein the second contact surface forms a third valve for sealingly engaging the piston guide seat.

8. A fuel injector as claimed in claim 7, wherein the piston guide further comprises a second aperture for providing a second fluid pathway past the piston guide seat.

9. A fuel injector as claimed in claim 1 further comprising a sleeve spring for biasing the needle sleeve.

10. A fuel injector as claimed in claim 1, wherein the first nozzle control valve and/or the second nozzle control valve is/are in fluid communication with a high pressure fuel supply line; and the first nozzle control valve and/or the second nozzle control valve is/are in fluid communication with a low pressure fuel return line.

* * * * *